US010358276B2

(12) United States Patent
Gammons et al.

(10) Patent No.: US 10,358,276 B2
(45) Date of Patent: Jul. 23, 2019

(54) WARMING BOX

(71) Applicant: Adroit Medical Systems, Inc., Loudon, TN (US)

(72) Inventors: Scott Gammons, Loudon, TN (US); Jeffrey B. Gammons, Loudon, TN (US)

(73) Assignee: Adroit Medical Systems, Inc., Loudon, TN (US)

( * ) Notice: Subject to any disclaimer, the term of this patent is extended or adjusted under 35 U.S.C. 154(b) by 440 days.

(21) Appl. No.: 15/191,803

(22) Filed: Jun. 24, 2016

(65) Prior Publication Data

US 2016/0376082 A1 Dec. 29, 2016

Related U.S. Application Data

(60) Provisional application No. 62/212,687, filed on Sep. 1, 2015, provisional application No. 62/185,003, filed on Jun. 26, 2015.

(51) Int. Cl.

| | |
|---|---|
| ***B65D 81/18*** | (2006.01) |
| ***B65D 21/02*** | (2006.01) |
| ***B65D 57/00*** | (2006.01) |
| ***B65D 81/34*** | (2006.01) |
| ***B65D 85/18*** | (2006.01) |

(52) U.S. Cl.

CPC ..... *B65D 81/18* (2013.01); *B65D 21/0223* (2013.01); *B65D 57/00* (2013.01); *B65D 81/3476* (2013.01); *B65D 85/18* (2013.01)

(58) Field of Classification Search

CPC ..... B65D 81/18; B65D 81/2015; B65D 81/2023; B65D 81/203; B65D 81/027; B65D 81/05; B65D 81/053; B65D 81/054; B65D 81/3476; B65D 21/0223; B65D 43/00; B65D 85/18; B65D 57/00; H05B 1/0272; H05B 1/023; H05B 1/0252; H05B 3/008; H05B 3/0085; H05B 3/009; H05B 3/342; H05B 3/345; H05B 3/347; H05B 3/34; H05B 3/28; H05B 3/023; A47K 10/10; A47K 10/025; A47K 10/06; A47J 36/06; A47J 36/2483; A47J 36/32; A47J 36/2433; A47J 39/02; A47J 47/14; A45C 11/20

See application file for complete search history.

(56) References Cited

U.S. PATENT DOCUMENTS 5,569,401 A * 10/1996 Gilliland ..... A47K 10/06 219/386

* cited by examiner

*Primary Examiner* — Shawntina T Fuqua

(74) *Attorney, Agent, or Firm* — Knox Patents; Thomas A. Kulaga

(57) ABSTRACT

Apparatus for warming cloths in a portable box. The warming box includes a heater assembly with slots configured to receive multiple packages of cloths. The slots are defined by panels that have embedded heaters. Heaters are also positioned at the bottom of the slots. Two temperature switches control the heaters in order to maintain the temperature of the packages with specified limits. One temperature switch is positioned above the slots on an inside surface of the lid. The other switch is located at the bottom of one of the slots. The lid also includes a tilt switch that de-energizes the heaters when the lid is opened. The warming box has feet configured to mate with corresponding recesses in the lid, thereby making the boxes stackable, such as when used with a docking station. The docking station has a wiring harness that provides power to each warming box.

20 Claims, 6 Drawing Sheets

WARMING BOX

STATEMENT REGARDING FEDERALLY SPONSORED RESEARCH OR DEVELOPMENT

Not Applicable

BACKGROUND

1. Field of Invention

This invention pertains to a portable warming box for personal cloths. More particularly, this invention pertains to an insulated box with heating panels spaced apart inside the box such that packages of bathing cloths fit inside. Further, the warming boxes are stackable in a docking station.

2. Description of the Related Art

For humans and other mammals, the first line of defense against pathogens is the physical barrier that encloses the body. That physical barrier is the skin, which prevents the entry of pathogens. But the skin must maintain its integrity and remain healthy. Proper skin care is essential to maintain this line of defense against pathogens.

Skin cleansers are known and have been in use for a long time. These cleansers include both chemical based compositions and mechanical based cleansers and combinations of chemical and mechanical based cleansers. The chemical based compositions include soaps, solvents, and anti-bacterial solutions, for example. Mechanical based cleansers include cloths, brushes, and scrubbers, for example. Cloths are often used to wash and bath the skin. Cloths are often used to apply chemical based cleansers and skin conditioners.

Warm or hot cloths have therapeutic value, both from the heat from the cloth and warmed chemicals, if any, in the cloth. To be useful, the cloth needs to be warmed within a narrow temperature range. Some cloths include a chemical based cleanser and/or conditioner that is best applied within a certain temperature range. If too hot, a person may be subject to discomfort and possibly burns. If too cool, a person may be subject to discomfort and a decreased therapeutic effect from constriction of blood vessels and reduced activation and/or volatility of any chemicals in the cloth.

BRIEF SUMMARY

According to one embodiment of the present invention, a warming box is provided. The warming box is an insulated box, similar to an ice chest. In one configuration, the box has four heater panels spaced about 2½ inches apart to form three slots. Each slot is sized is hold multiple packages of cloths, such as Theraworx Technology brand Hygiene Management System packages that contain 8 cloths. The packages fit three deep and two wide in each slot. The cloths are intended to be used at a suitable temperature that offers comfort to the person who is in contact with the cloth.

The heater panels are connected to a lid-mounted thermostat and there is another thermostat in the lower portion of the box. In one embodiment, the box includes a switch that detects when the lid is open or not fully closed. One type of such switch is a gravity switch that turns off the heaters when the lid is opened beyond about 30 degrees. The gravity switch includes a microswitch and one or more steel balls that move in a tube that has one end of the tube engaging the actuator of the microswitch. With the lid closed, the tube is angled such that the micro-switch contacts are closed by the weight of the balls against the switch actuator. When the lid is open, the tube is at an angle where the micro-switch contacts are open.

In one embodiment the boxes are stackable. Feet protruding from the bottom of each box are configured to be received in corresponding recesses in the lid of another box. In this way, multiple boxes are stackable and are in a stable configuration for transport of the multiple, stacked boxes. A docking station includes a platform that holds a plurality of stacked boxes. The docking station includes a power distribution panel that has a single power connection to an external power source and multiple power connections for the multiple warming boxes. In this way the cloths inside the warming boxes are kept at a desired temperature and are ready to be used when needed. The docking station allows the boxes to be kept ready for use and individual boxes are easily removable from the docking station for transport to where the warmed cloths are needed.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for warming packages of cloths is disclosed. The apparatus is a portable device with built-in safety devices as described below. Features are generally indicated with a reference number, such as 116 for the slots in the container 102. When a feature appears multiple times in a drawing, the different occurrences are distinguished in the figures and described below with an alphanumeric suffix, for example, 116-A, 116-B, 116-C for the three slots 116 in the container 102. Various components are illustrated both generically and specifically in the figures and in the following description. For example, the walls 112-A, 112-B are discussed individually and separately to ensure clarity when describing the configuration of each wall 112-A, 112-B. The walls 112, when referred to collectively, are referenced without an alphanumeric suffix.

Figure 1:
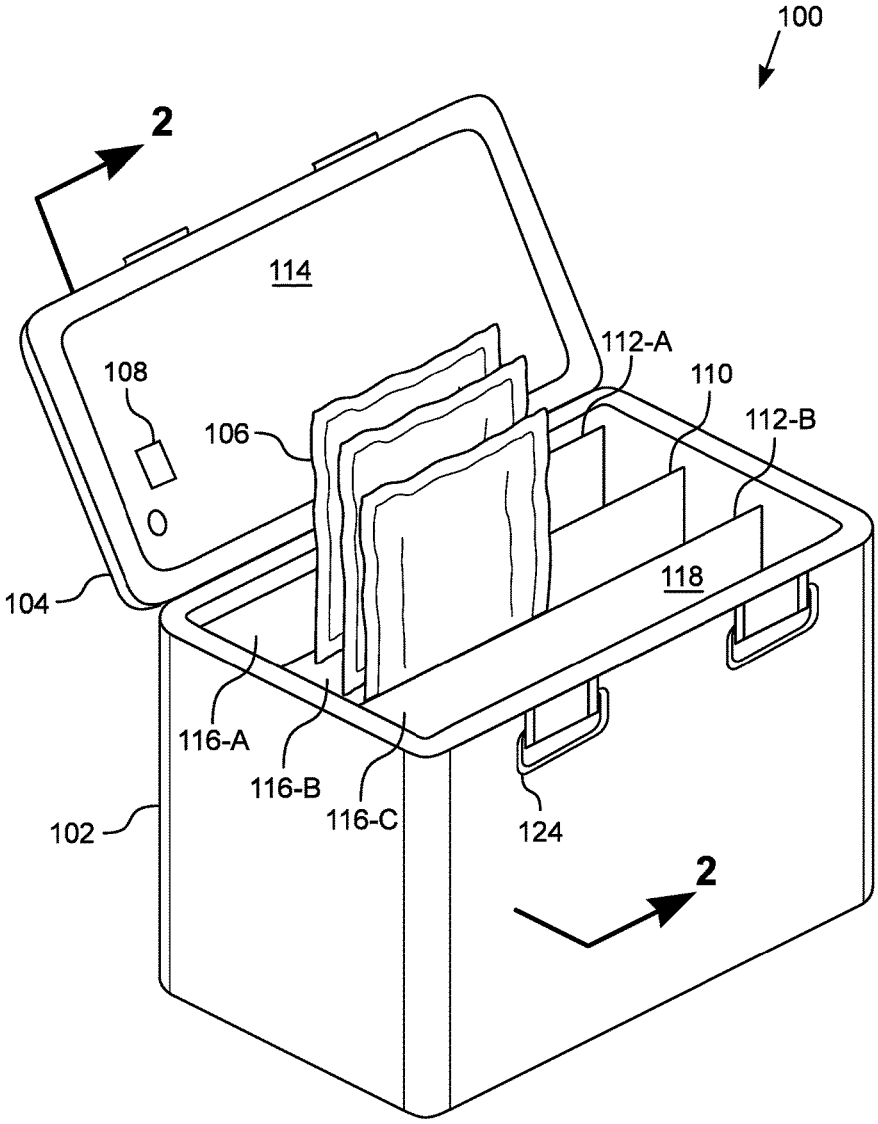
FIG. 1 is an isometric view of one embodiment of a warming box.

FIG. 1 illustrates an isometric view of one embodiment of a warming box 100. The warming box 100 has a container 102 and a lid 104. The container 102 and lid 104 together are an insulated enclosure, such as a common cooler or ice chest. The illustrated embodiment of the warmer box 100 has three slots 116 that receive packages 106 for warming. The packages 106 are any object desired to be heated. FIG. 1 shows three such packages 106 that are of the type that contain bathing cloths. The three packages 106 are positioned front-to-back and shown partially inserted in the middle slot 116-B. For one type of package 106 suitable for carrying multiple cloths, each slot 116 is sized to receive six packages 106—two packages across the width of the slot 116 and three packages 106 stacked front-to-back as shown in FIG. 1. The width of the slot 116 is the dimension from side-to-side inside the box 100. The back of the box 100 refers to the part of the box 100 where the lid 104 is hinged to the container 102. As used herein, a slot is defined as a groove or narrow space between two objects, where narrow refers to the relative dimensions of the space between the objects and the width of the space.

The container 102 includes a heater assembly 110 that has walls 112 that define the slots 116. A pair of walls 112-A are positioned against opposing inside walls of the container 102. Other walls 112-B are spaced between the outer walls 112-A and serve to separate the slots 116. The heater assembly 110 fits snugly inside the container 102 against all four inside walls of the container 102.

The lid 104 is connected to the container 102 with a hinge and is secured in the closed position with one or more latches 124. The lid 104, when closed, has an inside surface 114 that encloses the container cavity 118 that holds the heater assembly 110. In this way the heat inside the cavity 118 is held captive, thereby ensuring the contents 106 remain at a desired temperature. A temperature switch 108 is positioned proximate the inside surface 114 of the lid 104. The temperature switch 108 senses and is responsive to the temperature inside the cavity 118 when the lid 104 is in the closed position.

Figure 2:
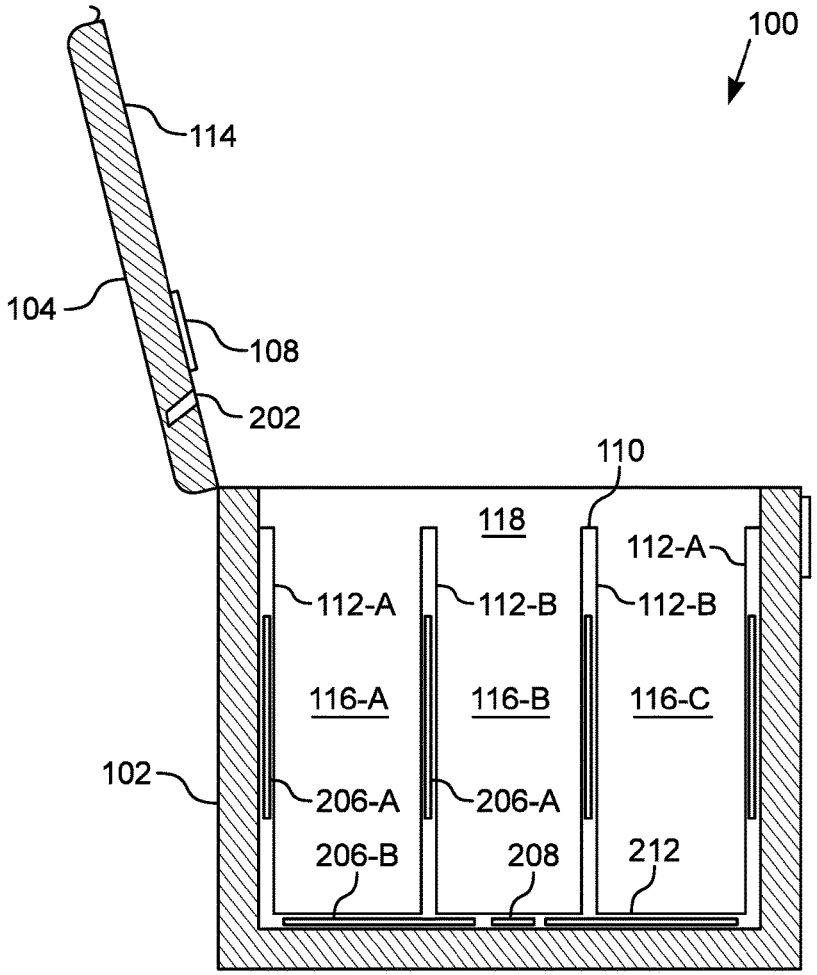
FIG. 2 is a cross-sectional view of the warming box shown in FIG. 2.

FIG. 2 illustrates a cross-sectional view of the warming box 100 shown in FIG. 2. The container 102 is a five-sided box with insulated walls. The lid 104 is an insulated panel that engages the top of the container 102, thereby enclosing the cavity 118. The temperature inside the cavity 118, as sensed by the temperature switch 108, is a nominal 105 degrees Fahrenheit. The insulation of the container 102 and lid 104 is sufficient to maintain the inside temperature over a range of outside ambient temperatures. In other embodiments, the temperatures vary depending upon the desired temperature of the objects being warmed in the slots 116.

The heater assembly 110 in the container 102 includes several walls 112 that extend from a floor panel 212 towards the top of the container 102. The walls 112 have an internal space into which fits heater panels 206-A. The floor panel 212 defines a space above the inside bottom of the container 102 into which fits heater panels 206-B. In one embodiment, each wall 112 has two heater panels 206-A and the space under the floor panel 212 has four heater panels 206-B. Those skilled in the art will recognize that the number and positioning of the heater panels 206 can vary without departing from the spirit and scope of the present invention.

Next to the floor panel 212 is a second temperature switch 208. The second switch 208 measures the temperature proximate the heaters 206-B at the bottom of the cavity 118. In another embodiment, the second switch 208 is located in the lower portion of one of the walls 112-B located medially in the cavity 118. The second temperature switch 208 has a nominal setpoint of 127 degrees Fahrenheit. Both the first and second temperature switches 108, 208 are thermostats that control the heaters 206, and consequently, the temperature inside the cavity 118.

The lid 104 includes the first temperature switch 108 and a tilt switch 202. The first, or lid, temperature switch 108 is positioned above the cavity 118 in the container 102 and is sensitive to the temperature in the cavity 118. The tilt switch 202 senses when the lid 104 is open and turns off the heaters 206. In one embodiment the tilt switch 206 actuates to turn off the heaters 206 when the lid 104 is raised approximately 30 degrees from the closed position.

Figure 3:
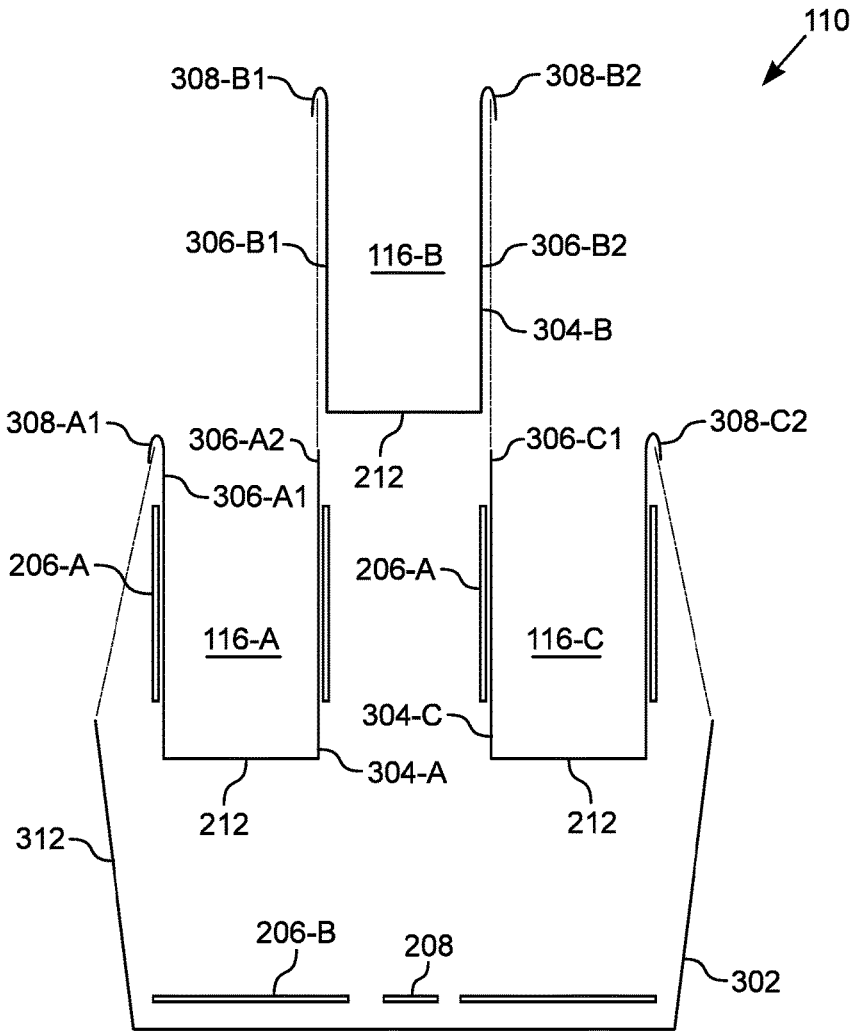
FIG. 3 is an exploded diagram showing one embodiment of the heater assembly.

FIG. 3 illustrates an exploded diagram showing one embodiment of the heater assembly 110. The heater assembly 110 includes various panels 302, 304 that are joined together to form an enclosure to hold the heaters 206. The panels 302, 304 are thin metal, for example, aluminum sheet that is 0.040 inches thick, bent into shapes that allow each of the panels 302, 304 to fit together as part of an assembly. The panels 302, 304 have a squared-off U-shape when seen from the end. The edges of the inner panels 304 are joined at Dutch bends 308. The various Dutch bends 308 receive sidewalls 312, 306 of corresponding panels 302, 304. The Dutch bends 308 form joints without sharp edges and the bends 308 add strength to the walls 112. The panels 302, 304 are powder coated to provide a smooth, easily cleaned surface that avoids contamination.

An outer panel 302 has a U-shape with the sidewalls 312 splayed out slightly. The outer panel 302 is sized to fit inside the container 102 with the edges of the panel 302 dimensioned and configured to fit snugly inside the cavity 118 of the container 102. The sidewalls 312 are splayed out in order to ensure that the sidewalls 312 contact the inside walls of the container 102 and to also hold the inside panels 306 in place by tension. That is, the sidewalls 312 engage and bias the bends 308-A, 308-C, thereby applying a force to the panels 304 that the inside panels 304 are held in place relative to the outer panel 302.

Three inner panels 304-A, 304-B, 304-C provide the outer surfaces that engage the packages 106 to be warmed. The first and third inner panels 304-A, 304-C are mirror images of each other with one side 306-A1, 306-C2 having an edge with a Dutch bend 308-A, 308-C and the other side 306-A2, 306-C1 of the inner panel 304-A, 304-C having a straight edge. The Dutch bends 308 receive the upper edge of the sidewalls 312, 306. In this way, the sidewall 306, 312 and the adjacent sidewall 306, 312 are joined with a space therebetween for a heater 206.

Dutch bends are sheet metal hems where the edge of one piece of sheet metal is doubled over into a narrow, U-shaped configuration that can receive another piece of sheet metal. A joint between two sheets of metal is formed by one sheet having a Dutch bend 308 with the other sheet being flat and inserted into the bend 308. In one embodiment, the Dutch bend 308 is crimped onto the other sheet for additional strength. The sidewall that fits into the Dutch bend 308 has a kink, or offset, such that the sidewalls 312, 316 are touching inside the Dutch bend 308, but separated by a space away from the bend 308. That space is sufficient to receive a heater 206. In one embodiment, that space between sidewalls 312, 316 is filled with a thermally conductive material that distributes heat across the wall 112 and also secures or holds the heaters 206 in position in the walls 112.

In the illustrated embodiment, the Dutch end 308-A1 joins the sidewall 306-A1 of the first inner panel 304-A with the sidewall 312 of the outer panel 302. The Dutch end 308-B1 joins the sidewall 306-A2 of the first inner panel 304-A with the sidewall 306-B1 of the second inner panel 304-B. The Dutch end 308-B2 joins the sidewall 306-B2 of the second inner panel 304-B with the sidewall 306-C1 of the third inner panel 304-C. The Dutch end 308-C2 joins the sidewall of the third inner panel 304-C with the sidewall 312 of the outer panel 302. In other embodiments, the sidewalls 312 of the outer panel 302 have the Dutch bends.

The second, or middle, inner panel 304-B have Dutch bends 308-B1, 308-B2 on each wall 306-B1, 306-B2. One Dutch bend 308-B1 receives the sidewall 306-A2 of the first inner panel 304-A and the other Dutch bend 308-B2 receives the sidewall 306-C1 of the third inner panel 304-C. In this way the sidewalls 306-B1, 306-B2 of the second panel 304-B and the corresponding adjacent walls 306-A2, 306-C1 of the first and third inner panels 304-A, 304-C are joined with a space therebetween for heaters 306-A.

With the inner panels 304 joined together and the panels 304-A, 304-C connected to the outer panel 302, there is a space between the floor, or base, 212 and the bottom, or base, of the outer panel 302 for heaters 206-B and the temperature switch 208. In one embodiment the temperature switch 208 is positioned inside a slot 116 of one of the inner panels 304 and not between the floor 212 and the outer panel 302.

Figure 4:
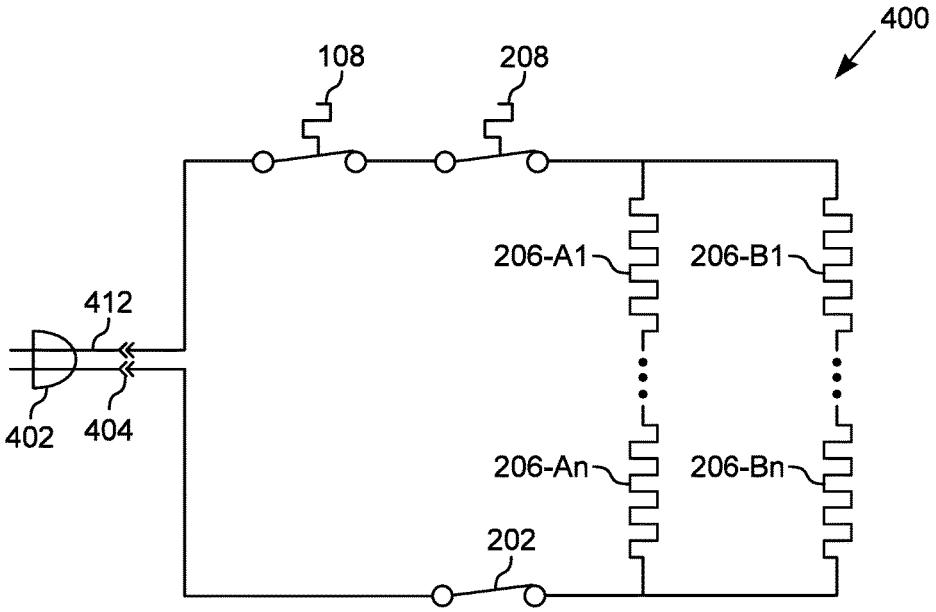
FIG. 4 is a schematic diagram of one embodiment of a heater circuit.

FIG. 4 illustrates a schematic diagram of one embodiment of a heater circuit 400. The heater circuit 400 connects to a power source, such as a 115 Vac circuit, with a plug 402. The plug 402 has a cable 412 that connects to the rest of the circuit 400 through a cable connector 404. The two temperature switches 108, 208 are connected in series, as is the tilt switch 202, with the heaters 206.

The heaters 206 are connected in a series-parallel arrangement in order to obtain a desired power consumption and heating rate. The illustrated embodiment shows two sets 206-A1 to 206-An, 206-B1 to 206-Bn of heaters 206 each connected in series with the two sets 206-A1 to 206-An, 206-B1 to 206-Bn connected in parallel. In one exemplary configuration, twelve heaters 206-A, 206-B are wired with three sets of four heaters 206 connected in series. Each set is connected in parallel with the other two sets of heaters 206. Each heater 206 is rated at 180 Watts and each string of four heaters 206-A1 to 206-An, 206-B1 to 206-Bn requires 45 Watts of power. The three strings of heaters 206 require a total of 135 Watts of power, which is three times the 45 Watts of each set. Those skilled in the art will recognize that the configuration of the heaters 206 in the circuit will vary depending upon the power dissipation of the heaters 206, the rate of heat to be generated inside the cavity 118, and the desired duty cycle of the heaters 206.

The two temperature switches 108, 208 regulate the temperature inside the cavity 118 by switching the heaters 206 on and off. The lid temperature switch 108 is above the packages 106 being warmed and ensures that the packages 106 do not exceed a maximum temperature. The lower temperature switch 208 is below the packages 106 and closest to the heaters 206. The lower switch 208 has a setpoint that ensures that the heaters 206 are energized at a high enough temperature that the packages 106 reach a consistent temperature throughout, but not so high that the packages 106 are subject to overheating.

The tilt switch 202 in the lid 104 ensures that the heaters 206 are de-energized when the lid 104 is open. An open lid 104 indicates that the box 100 is being loaded or unloaded with packages 106, or that the box 100 is not being used. In either case it is desirable to have the heaters 206 de-energized so as to avoid personal injury and wasting energy. Also, with the lid 104 closed and the heaters 206 energized, the lid temperature switch 108 is in position to adequately monitor the temperature in the space 118 above the packages 106.

In one embodiment the warming box 100 holds packages 106 of bathing cloths, such as used in a medical facility. The packages 106 are kept at a temperature nominally between 105 and 127 degrees Fahrenheit. The lid temperature switch 108 has a setpoint of 105 degrees Fahrenheit, plus or minus 5 degrees, and the lower temperature switch 208 has a setpoint of 127 degrees, plus or minus 5 degrees. The heaters 206 are disposed inside the various walls 112 such that the surfaces of the walls 112 are evenly heated, thereby ensuring that the packages 106 are evenly heated. The panels 302, 304 are a metal with good thermal conductivity, thereby minimizing the temperature variation across the outer surface of the panels 302, 304.

The illustrated embodiment shows circuit 400 powered on and energized whenever the plug 402 is connected to an energized power source. In another embodiment the warmer box 100 includes a power switch for selectively controlling its operation.

Figure 5:
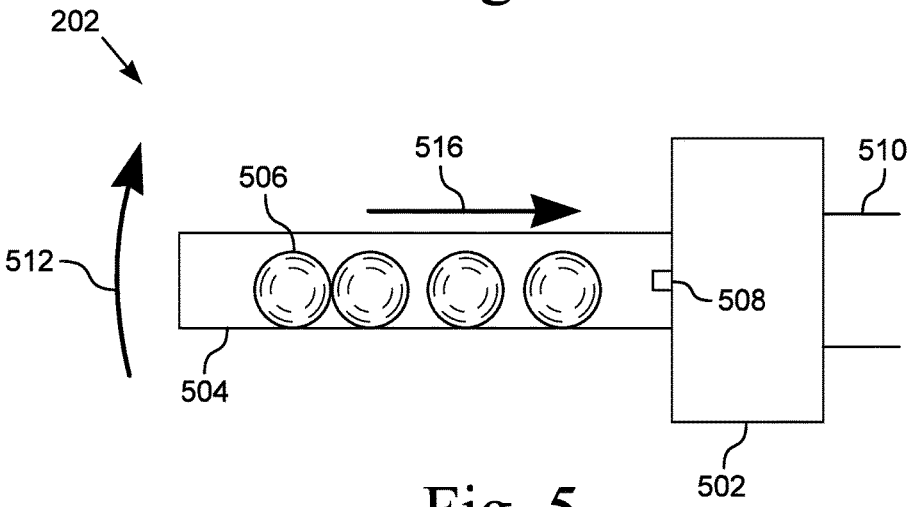
FIG. 5 is a side view of one embodiment of a tilt switch.

FIG. 5 illustrates a side view of one embodiment of a switch 202. The tilt switch 202 is a gravity switch that is mounted in the lid 104 such that the switch 202 is actuated when the lid 104 is in the closed position. The switch 202 forms an open circuit when the lid 104 is opened beyond a certain point. For example, the contacts of the tilt switch 202 open when the lid 104 is opened such that it forms at least a thirty degree angle with the top of the container 102. With the lid 104 in the open position, the heaters 206 are de-energized.

In the illustrated embodiment the tilt switch 202 includes a micro-switch 502 with a tube 504 extending away from the actuator 508. The micro-switch 502 includes an actuator 508 and a pair of leads 510 that provide the electrical connection for the switch 202. The micro-switch 502 actuates when the actuator 508 is depressed.

Inside the tube 504 are balls 506 sufficient in number and weight to actuate the micro-switch 502 when the switch 202 is tilted or rotated in a direction 512 that allows the balls 506 to roll or move in a direction 516 toward the actuator 508. The tilt switch 202 is actuated when the angle of the tube 504 is such that the weight of the balls 506 resting against the actuator 508 is sufficient to depress the actuator 508. In one embodiment the micro-switch 502 has normally open contacts that are closed when the balls 506 engage the actuator 508. In such an embodiment the tilt switch 202 is positioned in the lid 104 such that the balls 506 rest against the actuator 508 with the lid 104 in the closed position and roll away from the actuator 508 when the lid 104 is raised more than about thirty degrees from the closed position. In this way the heaters 206 are de-energized when the lid 104 is opened and the contacts of the micro-switch 502 are open. In another embodiment the micro-switch 502 has normally closed contacts that are opened when the balls 506 engage the actuator 508. In such an embodiment, the switch 202 is positioned in the lid such that the balls 506 engage the actuator 508 when the lid 104 is in the open position.

Figure 6:
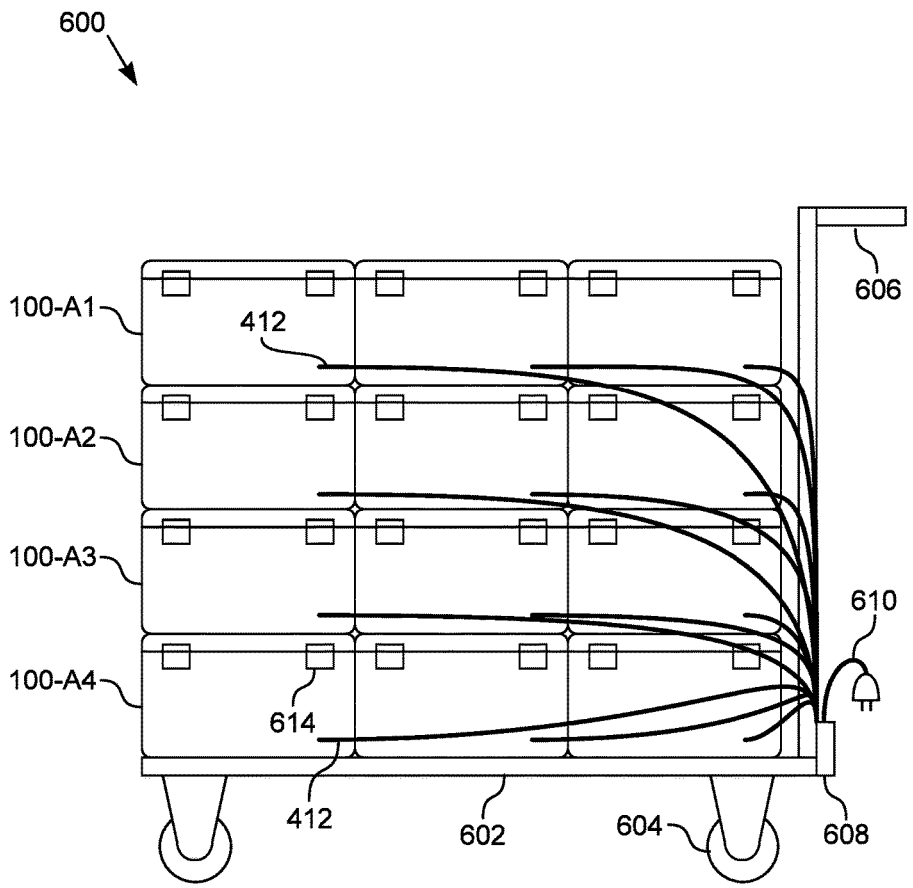
FIG. 6 is a side view of one embodiment of a docking station.

FIG. 6 illustrates a side view of one embodiment of a docking station 600. The docking station 600 includes a platform 602, a set of wheels 604, a push-handle 606, and a power distribution block 608. The platform 602 is dimensioned to hold a plurality of warming boxes 100-A1, 100-A2, 100-A3, 100-A4 that are stackable. For example, three warming boxes 100-A are positioned back-to-back with three adjacent warming boxes 100-A as one layer of warming boxes 100-A. FIG. 6 illustrates one-half of that configuration with four layers of three warming boxes 100-A with the power cables 412 visible as they are routed to the power distribution block 608. The other half of the warming boxes 100-A would be positioned with their back sides adjacent the backs of the warming boxes 100-A illustrated, with the cables 412 positioned between the warming boxes 100-A.

A power cable 610 extends from the power distribution block 608. The power cable 610 connects to an external power supply, such as the 115 Vac mains. In this way the docking station 600, when parked next to an electrical supply, provides power to multiple warming boxes 100-A such that a warming box 100-A is removable from the docking station 600 as needed or the docking station 600 is disconnected from the power supply and moved to where the warming boxes 100-A are needed.

Figure 7:
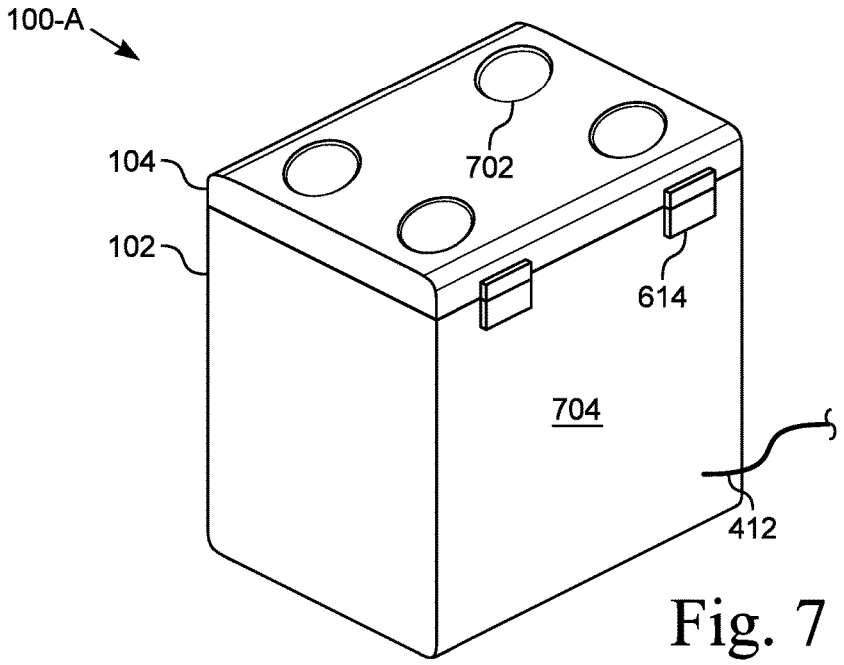
FIG. 7 is an isometric view of another embodiment of a warming box.
Figure 8:
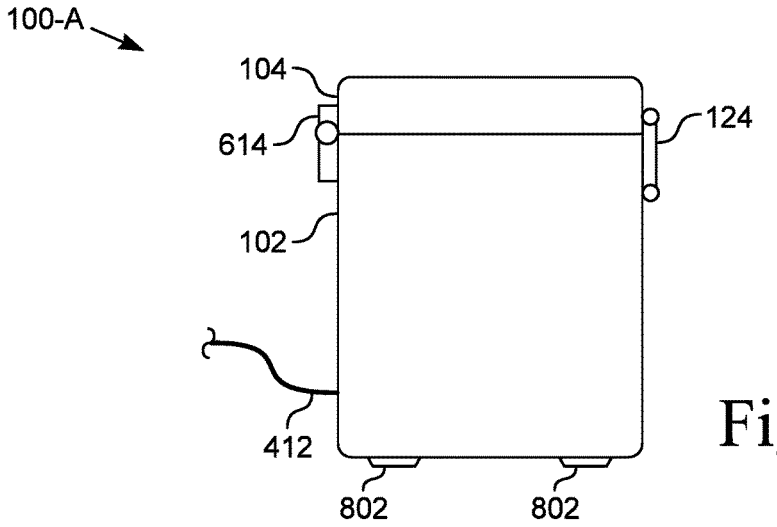
FIG. 8 is a side view of the embodiment of the warming box shown in FIG. 7.

FIG. 7 illustrates an isometric view of another embodiment of a warming box 100-A, such as shown in FIG. 6. FIG. 8 illustrates a side view of the embodiment of the warming box 100-A shown in FIG. 7. The warming box 100-A includes at least one hinge 614 on the back side 704 connecting the lid 104 to the container 102. The front side of the warming box has at least one latch 124. Extending from the back side 704, in the illustrated embodiment, is the cable 412 that connects power to the heaters 206. For the embodiment illustrated in FIG. 4, the cable 412 plugs into a connector 404 fixed to the container 102. In this way when a warming box 100-A is removed from the docking station 600, the power cable 412 on the docking station 600 is unplugged from the warming box 100-A. If the warming box 100-A is going to be used away from the docking station 600 for an extended time then another cable 412 is plugged the warming box 100-A and connected to another external power source.

Each of the warming boxes 100-A includes a set of feet or protrusions 802 on the bottom surface of the box 100-A. The top of the lid 104 has corresponding recesses or indentations that receive the protrusions 802 of another warming box 100-A3 that is positioned on top of the box 100-A4. In the illustrated embodiment the protrusions 802 have the shape of a truncated cone such that a warming box 100-A3 is easily indexed on a lower box 100-A4, and, when seated together, the pair of boxes 100-A4, 100-A3 are sufficiently secured laterally that the two boxes 100-A4, 100-A3 are stable during transport. In other embodiments the protrusions 802 have other configurations, such as a right-angle corner protrusion, that mate with corresponding recesses 702 in the top 104 of the warming box 100-A.

The warming box 100 includes various functions. The function of deenergizing the heaters 206 when the box 100 is open is implemented, in one embodiment, by the switch 202 that opens the circuit supplying power to the heaters 206, as illustrated in FIGS. 2 and 4.

The function of maintaining a temperature is implemented, in one embodiment, by a pair of temperature switches 108, 208 with one switch 108 located above the heaters 206 and the other switch 208 located adjacent the bottom of the cavity 118 in the box 100.

The function of heating is implemented, in one embodiment, by the heaters 206 positioned inside the walls 112 that define the slots 116 inside the cavity 118 in the box 100.

From the foregoing description, it will be recognized by those skilled in the art that a warming box 100 for warming, or heating, cloths has been provided. The warming box 100 includes slots 116 that receive packages 106 to be warmed and maintained at a desired temperature. The slots 116 are defined by the sidewalls 306 of panels 304 that interlock together. Heaters 206 are disposed between the panels 304 and under the floor 212 of the slots 116.

Furthermore, it will be recognized by those skilled in the art that a docking station 600 has been provided. The docking station 600 has a platform 602 sized to hold a plurality of warming boxes 100-A. A wiring harness connects each warming box 100-A to a power distribution block or device 608, which has a cable 610 configured to connect to an external power source. The warming boxes 100-A are stackable with a stable configuration provided by the protrusions 802 on the bottom of one box 100-A1, 100-A2, 100-A3 engaging recesses in the top of the lower warming box 100-A2, 100-A3, 100-A4, respectively.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for warming multiple objects, said apparatus comprising:

a container having four container sidewalls and a container base, said container defining a cavity, said container being insulated;

a lid dimensioned and configured to fit said container opposite said container base, said lid enclosing said cavity when said lid is in a closed position;

an outer panel having a first outer base, a first outer sidewall, and a second outer sidewall, said first outer sidewall positioned adjacent a first one of said four container sidewalls, said second outer sidewall positioned adjacent a second one of said one of said four container sidewalls, said outer panel extending from a third one of said four container sidewalls to a fourth one of said container sidewalls;

a first inner panel having a first inner panel base, a first inner panel first sidewall, and a first inner panel second sidewall, said first inner panel base positioned adjacent said first outer sidewall of said outer panel, said first inner panel base positioned adjacent said container base, said first inner panel extending from said third one of said four container sidewalls to said fourth one of said container sidewalls, said first inner panel first sidewall is joined with said first outer sidewall with a first hem, said first hem including a first edge bent over into a narrow U-shape and a second edge inserted into said narrow U-shape;

a first heater of a plurality of heaters positioned between said first inner panel first sidewall and said first outer sidewall;

a second heater of said plurality of heaters positioned between said first inner panel base and said container base;

a second inner panel having a second inner panel base, a second inner panel first sidewall, and a second inner panel second sidewall, said first inner panel base positioned adjacent said second outer sidewall of said outer panel, said first inner panel base positioned adjacent said container base, said second inner panel extending from said third one of said four container sidewalls to said fourth one of said container sidewalls, said second inner panel first sidewall is joined with said first outer sidewall with a second hem including a first edge bent over into a narrow U-shape and a second edge inserted into said narrow U-shape;

a third heater of said plurality of heaters positioned between said second inner panel first sidewall and said second outer sidewall; and a fourth heater of said plurality of heaters positioned between said second inner panel base and said container base.

2. The apparatus of claim 1 further including a first temperature switch positioned above said cavity proximate said lid, said first temperature switch operatively connected to a heater circuit to de-energize said plurality of heaters when said first temperature switch is actuated at a first setpoint.

3. The apparatus of claim 2 further including a second temperature switch positioned proximate said container base, said second temperature switch operatively connected to said heater circuit to de-energize said plurality of heaters when said second temperature switch is actuated at a second setpoint.

4. The apparatus of claim 1 further including a switch associated with a position of said lid, said switch operatively connected to a heater circuit to de-energize said plurality of heaters when said lid is in an open position relative to said container.

5. The apparatus of claim 4 wherein said switch is a gravity operated switch having at least one ball configured to press against an actuator of said switch when said lid is in said open position.

6. The apparatus of claim 1 wherein said first inner panel and said second inner panel define a pair of slots configured to receive a plurality of objects for warming by said heater assembly.

7. The apparatus of claim 1 wherein said container has an outside bottom with a first set of protrusions and said lid has an outside surface with a set of recesses dimensioned and configured to receive a second set of protrusions configured identically to said first set of protrusions, whereby a second container fits onto said lid.

8. The apparatus of claim 7 further including a docking station having a power distribution block, said power distribution blocking having a plurality of electrical connections configured to power a plurality of warming boxes as described in claim 1.

9. An apparatus for warming a plurality of objects, said apparatus comprising:

a container having four sidewalls and a base defining a cavity, said container being insulated;

a lid dimensioned and configured to fit said container opposite said base, said lid enclosing said cavity when said lid is in a closed position;

a heater assembly dimensioned to fit inside said cavity, said heater assembly including a plurality of walls that include a plurality of heaters, said plurality of heaters in a heater circuit, a plurality of slots each defined by two adjacent ones of said plurality of walls;

a first temperature switch positioned proximate said heater assembly, said first temperature switch operatively connected to said heater circuit to de-energize said plurality of heaters when said first temperature switch is actuated at a first setpoint; and a switch associated with said lid, said switch operatively connected to said heater circuit to de-energize said plurality of heaters when said lid is in an open position relative to said container.

10. The apparatus of claim 9 further including a second temperature switch positioned above said heater assembly, said second temperature switch operatively connected to said heater circuit to de-energize said plurality of heaters when said second temperature switch is actuated at a second setpoint.

11. The apparatus of claim 9 further including a second temperature switch positioned above said heater assembly, said second temperature switch operatively connected to said heater circuit to de-energize said plurality of heaters when said second temperature switch is actuated at a second setpoint.

12. The apparatus of claim 9 wherein said heater assembly includes an outer panel, a first panel, and a second panel, said outer panel configured to fit proximate two of opposite ones of said four container sidewalls, said outer panel configured to fit proximate said container base in said cavity, at least one of said plurality of heaters positioned between said outer panel and said container base, said first and second panels each having a pair of panel sidewalls that are substantially parallel and a panel base connecting said pair of panel sidewalls thereby defining one of said plurality of slots, one of said pair of panel sidewalls of said first panel attached to a first outer sidewall of said outer panel with one of said plurality of heaters positioned therebetween, and one of said pair of panel sidewalls of said second panel attached to a second outer sidewall of said outer panel with another one of said plurality of heaters positioned therebetween.

13. The apparatus of claim 9 wherein said heater assembly includes a base member that fits inside said cavity and conforms to a pair of opposing sidewalls of said container and to said base, said heater assembly further includes a first inner member that has a pair of sidewalls and a floor panel, said pair of sidewalls defining one of said plurality of slots therebetween, a distal edge of one of said pair of sidewalls of said first inner member engaging a distal edge of one of a pair of opposing sidewalls of said base member, at least one of said plurality of heaters positioned between said one of said pair of sidewalls of said first inner member and said one of said pair of opposing sidewalls of said base member, and at least one of said plurality of heaters positioned between said floor panel and said base member.

14. The apparatus of claim 13 further including a second inner member that has a pair of sidewalls and a floor panel, said pair of sidewalls of said second inner member defining another one of said plurality of slots therebetween, a distal edge of one of said pair of sidewalls of said second inner member engaging a distal edge of an other one of said pair of sidewalls of said first inner member, and at least one of said plurality of heaters positioned between said one of said pair of sidewalls of said second inner member and said other one of said pair of opposing sidewalls of said first inner member.

15. The apparatus of claim 13 wherein said distal edge of said one of said pair of sidewalls of said first inner member has a first Dutch bend receiving said distal edge of said one of said pair of opposing sidewalls of said base member.

16. The apparatus of claim 9 wherein said container has an outside bottom with a first set of protrusions and said lid has an outside surface with a set of recesses dimensioned and configured to receive a second set of protrusions configured identically to said first set of protrusions, whereby a second container fits onto said lid.

17. The apparatus of claim 16 further including a docking station having a power distribution block, said power distribution blocking having a plurality of electrical connections configured to power a plurality of warming boxes as described in claim 9.

18. An apparatus for warming multiple objects, said apparatus comprising:

a container having four container sidewalls and a container base, said container defining a cavity, said container being insulated;

a lid dimensioned and configured to fit said container opposite said container base, said lid enclosing said cavity when said lid is in a closed position;

an outer panel having a first outer base, a first outer sidewall, and a second outer sidewall, said first outer sidewall positioned adjacent a first one of said four container sidewalls, said second outer sidewall positioned adjacent a second one of said one of said four container sidewalls, said outer panel extending from a third one of said four container sidewalls to a fourth one of said container sidewalls;

a first inner panel having a first inner panel base, a first inner panel first sidewall, and a first inner panel second sidewall, said first inner panel base positioned adjacent said first outer sidewall of said outer panel, said first inner panel base positioned adjacent said container base, said first inner panel extending from said third one of said four container sidewalls to said fourth one of said container sidewalls;

a first heater of a plurality of heaters positioned between said first inner panel first sidewall and said first outer sidewall;

a second heater of said plurality of heaters positioned between said first inner panel base and said container base;

a second inner panel having a second inner panel base, a second inner panel first sidewall, and a second inner panel second sidewall, said first inner panel base positioned adjacent said second outer sidewall of said outer panel, said first inner panel base positioned adjacent said container base, said second inner panel extending from said third one of said four container sidewalls to said fourth one of said container sidewalls;

a third heater of said plurality of heaters positioned between said second inner panel first sidewall and said second outer sidewall;

a fourth heater of said plurality of heaters positioned between said second inner panel base and said container base, and a switch associated with a position of said lid, said switch operatively connected to a heater circuit to de-energize said plurality of heaters when said lid is in an open position relative to said container.

19. The apparatus of claim 18 wherein said switch is a gravity operated switch having at least one ball configured to press against an actuator of said switch when said lid is in said open position.

20. The apparatus of claim 18 further including a first temperature switch positioned above said cavity proximate said lid, said first temperature switch operatively connected to said heater circuit to de-energize said plurality of heaters when said first temperature switch is actuated at a first setpoint.

* * * * *